United States Patent [19]

Capes et al.

[11] 4,033,729

[45] July 5, 1977

[54] METHOD OF SEPARATING INORGANIC MATERIAL FROM COAL

[75] Inventors: Charles E. Capes; René J. Germain; Allan E. McIlhinney; Ira E. Puddington; Aurelio F. Sirianni, all of Ottawa, Canada

[73] Assignee: Canadian Patents and Development Limited, Ottawa, Canada

[22] Filed: Apr. 26, 1976

[21] Appl. No.: 680,592

[30] Foreign Application Priority Data

June 20, 1975 Canada ..... 229763

[52] U.S. Cl. ..... 44/1 A; 44/6

[51] Int. Cl.² ..... C10L 9/00; C10L 10/00; C10L 9/10

[58] Field of Search ..... 44/1 A, 16 R, 6, 16 C; 264/117

[56] References Cited

UNITED STATES PATENTS

| | | | |
|---|---|---|---|
| 1,420,165 | 6/1922 | Trent | 44/1 A |
| 3,932,145 | 1/1976 | Foulkes | 44/6 X |

*Primary Examiner*—Carl F. Dees
*Attorney, Agent, or Firm*—Francis W. Lemon

[57] ABSTRACT

A high proportion of the inorganic materials, (ash) content is removed from coal by providing the coal as a suspension with a liquid hydrocarbon oil, mixing an aqueous agglomerating liquid comprising water with the suspension, mixing a particulate material having a hydrophilic surface that is readily wetted by liquid water with the suspension, agitating the suspension to agglomerate the ash, and then separating the ash from the remainder. The particulate material having a hydrophilic surface may be ash, agglomerated silica flour, coarse silica chips, limestone or peat moss, and a binder for the ash may be dispersed or dissolved in the aqueous agglomerating liquid. In some instances the coal may be initially in the form of an aqueous suspension, and the coal can either be agglomerated from the suspendant by using a portion of the liquid hydrocarbon oil and then adding the remainder, or filtered therefrom and then the filter cake mixed with the liquid hydrocarbon oil.

4 Claims, 8 Drawing Figures

METHOD OF SEPARATING INORGANIC MATERIAL FROM COAL

Figure 1:
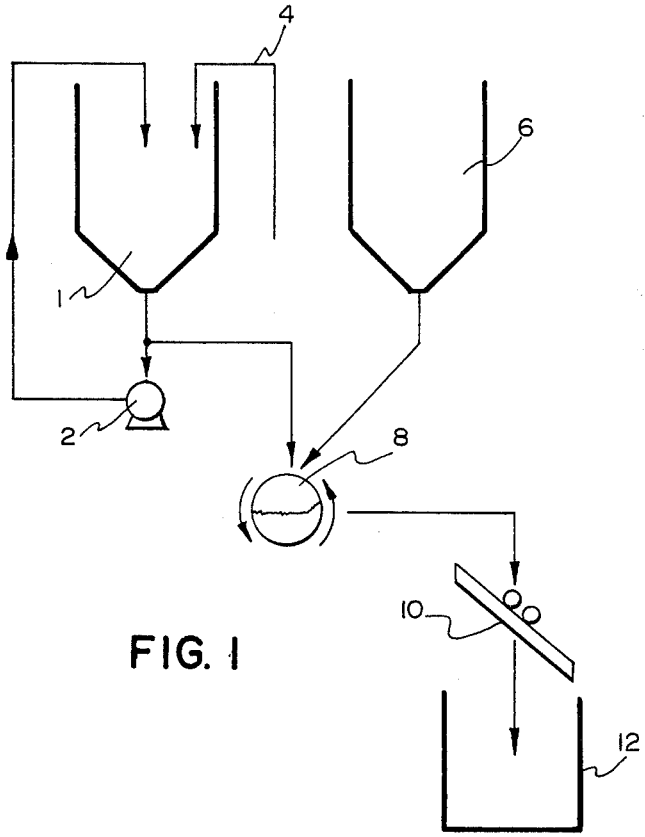

This invention relates to a method of separating inorganic material from coal.

Coal impurities are undesirable as they are pollutants and reduce the coal's calorific value. To remove these impurities preparation plants crush, wash, and dry the coal. Originally these plants discarded the −28 mesh material, but the proportion of these fines has increased due to mechanization and the need to grind the coal to its liberation size in order to meet more stringent pollution standards. Modern preparation plants treat these fines by flotation, but this method is inefficient when the feed contains considerable −100 mesh coal. Pulp densities of 3% and less are required to treat −200 mesh fines. To dry a flotation concentrate it must first be filtered to a cake of about 35% moisture and then be thermally dried to desired moistures of less than 10% The thermal drying of fines is currently thought to be the only practical method of reaching these moisture levels, but it is costly and undesirable as it oxidizes the coal and a possible fire hazard is always present.

The increasing importance of coal as a source of energy, light hydrocarbons, and gas and coke has resulted in the development of new techniques for handling coarse and fine coals. One promising method is based upon the phenomenon of spherical agglomeration.

Agglomeration is a size enlargement process wherein discrete particles are collected to form large granules. In the spherical agglomeration process finely divided solids in liquid suspension are agglomerated and separated from the suspending liquid by a small amount of a second, bridging liquid which preferentially wets the solids, yet is immiscible with the first liquid. With proper agitation or tumbling, compact spherical agglomerates can be formed. Spherical agglomeration can be applied to coal preparation by agglomerating the coal in what may be called the forward process or, by agglomerating the ash in what may be called the reverse process.

In the forward process the coal is ground in water. Typically, all particles are finer than 100 $\mu$ with considerable proportons finer than 40 $\mu$. A hydrocarbon briging liquid is added and the slurry is agitated using a high shear mixer. The hydrocarbon disperses and subsequently displaces the water on the coal particle surfaces, thus enabling small coal agglomerates to form as the hydrocarbon layers coalesce during particle collisions. The coal fraction can be separated from the ash suspension by screening.

In the reverse process the coal is ground and dispersed in a liquid hydrocarbon. Water, which is now the bridging liquid, is added to the slurry, which is agitated. The water displaces the liquid hydrocarbon covering the ash particles and the coal is beneficiated by agglomerating inorganic materials such as ash therefrom. The ash and other inorganic materials are the minor constituents of the coal as it is mined, usually amounting to less than 50% by weight of the total solids and often even less than 20% by weight of the total solids. When a coal containing 20% by weight inorganic materials is suspended in a particulate form in a liquid hydrocarbon and water is added, the chances of the water contacting the ash and other inorganic materials are slim unless lengthy mixing times are employed. The greater the number of coal particles present the greater is the tendency for them to mask the ash and other inorganic materials from the water. Also, once water wetted, the chances of two or more particles of ash and/or other inorganic materials contacting one another are less than that of particles of ash and other inorganic materials coming into contact with coal particles. For coals with an organic materials content below 20% the problem is worse. If the mixed slurry and agglomerates were poured onto a screen, very little beneficiation would result.

It is an object of the present invention to provide a method of separating inorganic materials from coal, using the reverse process, wherein:

a. the chances of water contacting the ash are greatly improved without undue lengthy mixing times being necessary, b. the great number of coal particles present does not undesirably increase the tendency for them to mask the ash and other inorganic materials from the water, and c. once water wetted, the chances of two or more particles of ash and/or other inorganic materials contacting one another and being agglomerated are greatly improved.

According to the present invention there is provided a method of separating inorganic materials from coal, comprising:

a. providing the coal, containing the inorganic materials, in particulate form as a suspension with a liquid hydrocarbon oil, b. mixing an aqueous agglomerating liquid comprising water, which is immiscible with the liquid hydrocarbon oil, with the suspension, c. mixing a particulate material having a hydrophilic surface that is readily wetted by liquid water with the suspension.

d. agitating the suspension, with the aqueous agglomerating liquid and particulate material having a hydrophilic surface mixed therewith, to agglomerate inorganic particulate materials in the suspension with the aid of the said particulate material having a hydrophilic surface, while leaving at least a major portion of the particulate coal dispersed in the liquid hydrocarbon oil, and then e. separating the agglomerated inorganic material from at least a major portion of the liquid hydrocarbon oil and pulverized coal.

The particulate material having a hydrophilic surface that is readily wetted by liquid water increases the total hydrophilic surface area available for contact with the aqueous agglomerating liquid and for agglomeration. The particulate material having a hydrophilic surface can be as fine as the ash and other inorganic materials or it can be quite coarse. Energetically speaking, a small particle will agglomerate with a large particle more easily than with another small particle. Thus a coal with an ash and other inorganic material content of 20% by weight, with very fine particles of a material having a hydrophilic surface will agglomerate in much the same manner as a coal having an ash and other inorganic material content of 50% by weight because the extra ash provides the additional hydrophilic surface.

Tumbling is one method of mixing the particles having a hydrophilic surface and the wetted slurry of coal and liquid hydrocarbon oil.

Figure 2:
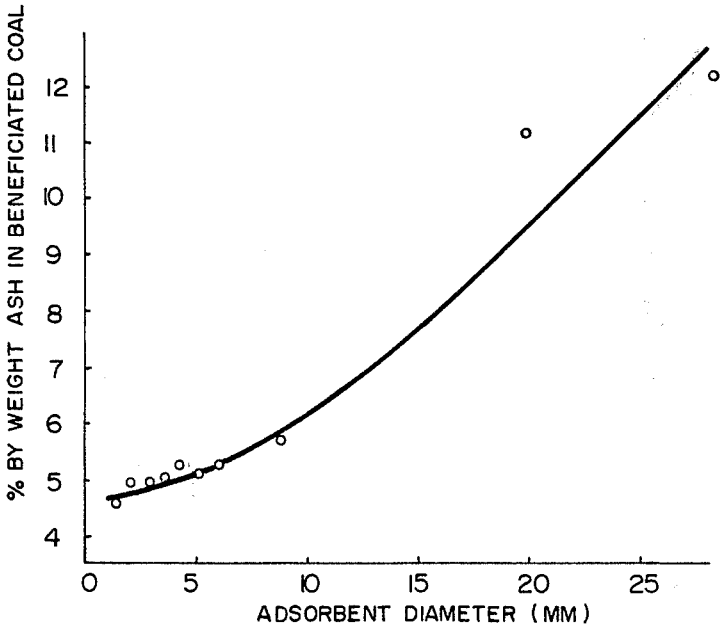
Figure 4:
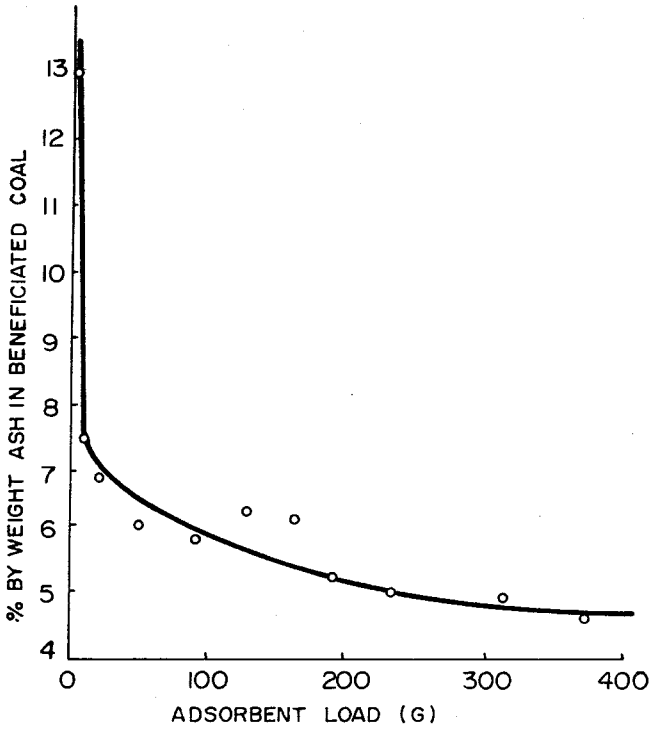
Figure 3:
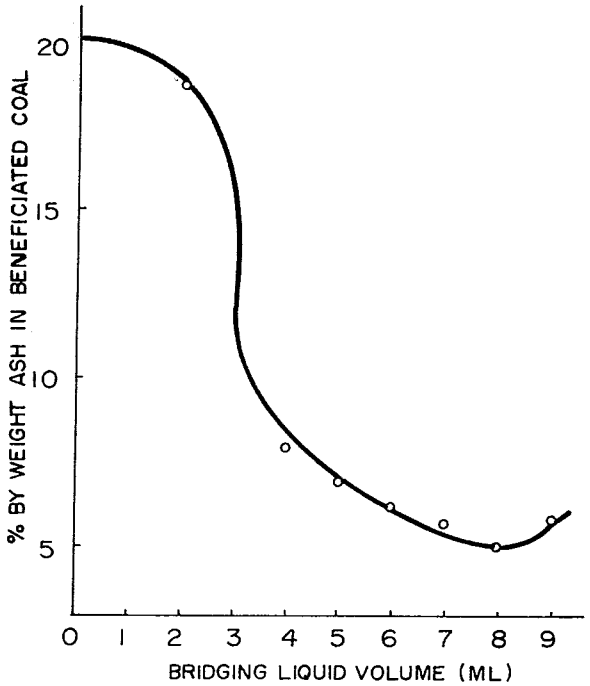
Figure 6:
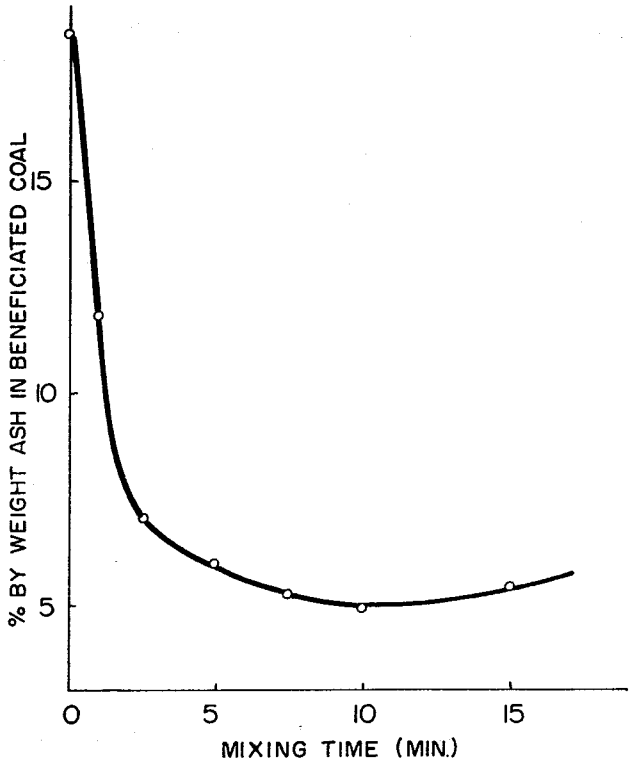
Figure 5:
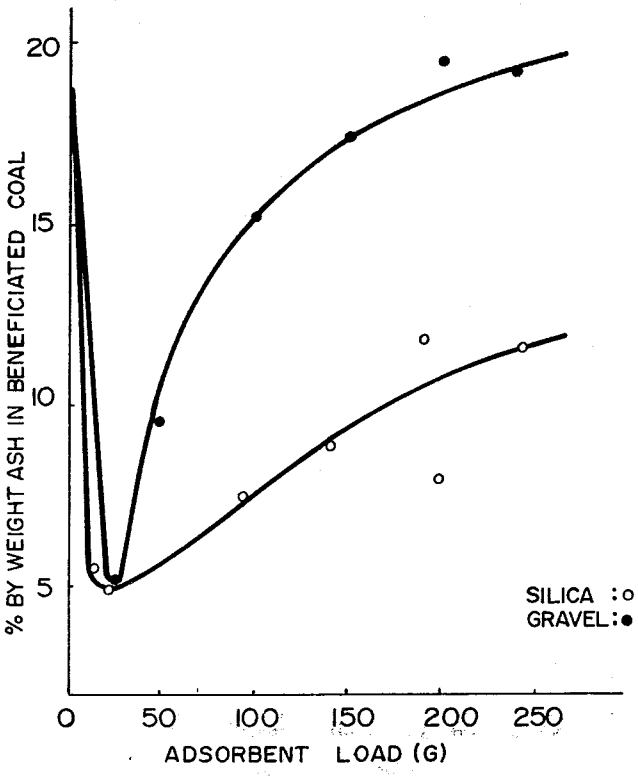
Figure 8:
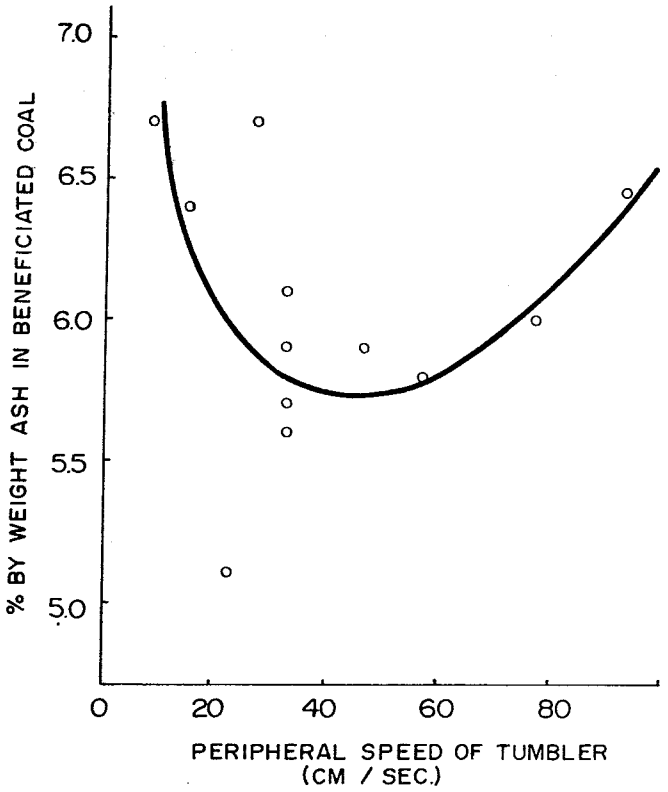
Figure 7:
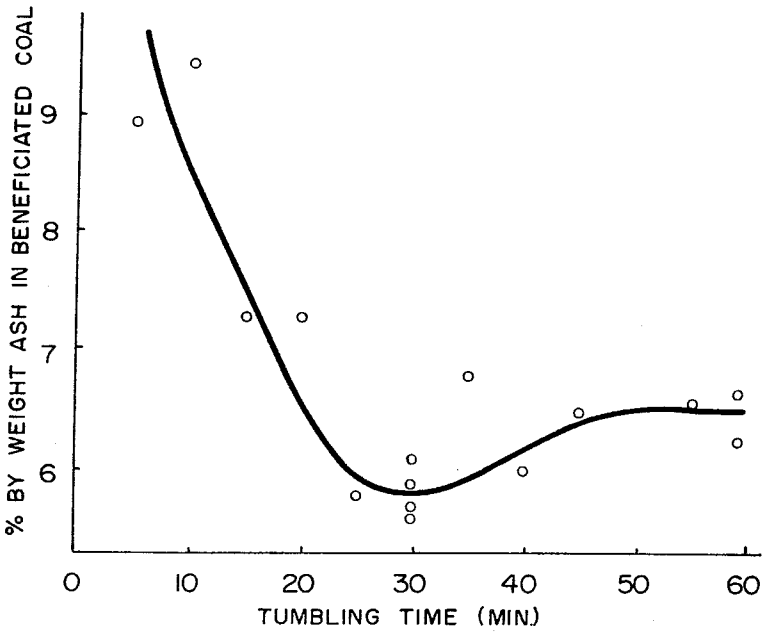

In the accompanying drawings which illustrate, by way of example, embodiments of the present invention, FIG. 1 is a diagrammatic view of an apparatus for the beneficiation of bituminous coal by ash agglomeration, FIG. 2 is a graph of the % by weight ash beneficiation of bituminous coal plotted against the diameter of agglomerated wet silica flour as the particulate material having a hydrophilic surface, FIG. 3 is a graph showing the effect of the content of aqueous agglomerating liquid on the % by weight ash agglomeration of bituminous coal using dry silica chips as the particulate material having a hydrophilic surface, FIG. 4 is a graph showing the effect of the loading of wet, ash coated gravel, as the particulate material having a hydrophilic surface, on the % by weight ash aggomeration of bituminous coal, FIG. 5 is a graph showing the loading effect of dry silica chips or ash coated gravel, as the particulate material having a hydrophilic surface, on % by weight ash beneficiation of bituminous coal, FIG. 6 is a graph showing the mixing time for dry silica chips, as the particulate material having a hydrophilic surface, plotted against the % by weight ash agglomeration of bituminous coal, FIG. 7 is a graph showing the effect of tumbling time of wet, ash coated gravel, as the particulate material having a hydrophilic surface, plotted against the % by weight ash in the agglomerates of bituminous coal, and FIG. 8 is a graph showing the effect of the peripheral speed of the interior of an agglomerating tumbler, using a wet, ash coated gravel as the particulate material having a hydrophilic surface, plotted against the % by weight ash agglomeration of bituminous coal.

Referring to FIG. 1, a bituminous coal assaying 20% by weight ash was pulverized, by means not shown, to 100% −200 mesh in a liquid hydrocarbon oil in the form of varsol, hexane or trichloroethylene, and then stored in a coal slurry holding tank 1. A paint shaker or a centrifugal pump 2 was used as a mixer to mix the coal slurry in the tank 1 to maintain the suspension while water was added thereto, by pipe 4, as the agglomerating liquid for the water wettable, inorganic material in the bituminous coal.

A tank 6 containing a particulate material having a hydrophilic surface was provided and the tanks 4 and 6 were both arranged to feed their contents to a rotating, baffled polyethylene bottle 8 to be gently tumbled therein. The polyethylene bottle 8 was rotated about a horizontal axis. Polyethylene was used as its hydrophobic surface prevented ash from sticking to the inner wall of the polyethylene tumbler 8.

After gently tumbling the suspension, water and particulate material having a hydrophilic surface in the polyethylene tumbler 8, for a sufficient time for these substances to be thoroughly mixed for agglomeration of the ash to have occurred, the contents of the tumbler were discharged on to a vibrating screen 10 to separate any ash agglomerates therefrom and the remaining slurry was collected in a container 12.

In the first tests the bituminous coal assaying 20% by weight ash in the tank 1 had the ash content raised to approximately 40% by weight by adding dried ash thereto. Water from pipe 4 was then dispersed in the slurry, until the slurry comprised approximately 17% by weight dry solids per 100 ml of suspending liquid, and the water thoroughly mixed in the slurry in the tank 1.

The slurry with the water thoroughly mixed therewith was fed to the tumbler 8 and gently tumbled therein for about 30 minutes without adding any particulate material from tank 6, and then the contents of the tumbler 6 were discharged on to the screen 10 to separate agglomerated ash from the remainder.

The results of the first tests are given in the following Table 1.

TABLE 1

| Starting % Ash | Final % Ash | % Recovery of combustibles | Mixer[a] | Suspending Liquid[b] | Agglomerate Size (mm.) |
|---|---|---|---|---|---|
| 42.3 | 5.8 | 82.6 | P.S. | Hexane | −2 |
| 33.8 | 6.1 | 79.3 | " | 65% varsol 35% Tr. | 2 → 5 |
| 36.8 | 5.7 | 84.3 | " | 50% varsol 50% Tr. | 0.5 → 3 |
| 42.0 | 6.8 | 82.6 | " | Hexane | — |
| 42.8 | 9.5 | 86.5 | " | Hexane | — |
| 41.1 | 28.2 | 83.9 | " | Tr. | 1 → 5 |
| 39.0 | 6.9 | 84.4 | C.P. | Tr. | 5 → 25 |
| 42.9 | 22.8 | 88.6 | C.P. | Tr. | 0.1 → 10 |

[a]P.S. Paint Shaker C.P. Centrifugal Pump
[b]Tr. Trichloroethelene

Similar tests were then carried out with the same bituminous coal assaying 20% by weight ash but without the addition of any ash to raise the ash content, or with the addition of any particulate material from tank 6, and in these tests very little agglomeration of the ash occurred even after prolonged tumbling. Very little beneficiation of the coal took place. From this it was deduced that the additional ash added in the previous tests acted as additional particles having a hydrophilic surfaces, increasing the total surface area for contact and the size of hydrophilic surface available for agglomeration.

Tests were then carried out with the same bituminous coal assaying 20% by weight ash, without the addition of any ash but with the addition of particulate material from tank 6. The particulate materials having a hydrophilic surface and used in tank 6 were ash, agglomerated silica flour, peat moss, coarse silica chips, limestone and gravel, and agglomeration of the ash again took place. The results of these tests are given below.

THE EFFECTS OF ADSORBENTS

CONTACT AREA

Previously it was mentioned that agglomeration, and hence beneficiation, depended largely on the aqueous agglomerating or bridging liquid-particle and particle-particle contact. By adding adsorbing agents, in the form of particulate material having a hydrophilic surface, the total surface area for contact and the size of individual adsorbing surfaces is increased. FIG. 2 illustrates (for wet adsorbents) the extent to which contact surface area aids beneficiation. In FIG. 2 the % by weight ash beneficiation of the coal is plotted against the particle diameter of the adsorbent, in the form of wet agglomerated silica flour. In all cases 100 g of wet agglomerated silica flour was added to 47g of coal. For equal weights, the smallest adsorbents produce the largest surface area, as well as the best ash reduction. There is approximately a 300% increase in surface area between the smallest and largest adsorbents, and a 7.4% by weight reduction in ash. The tests indicated that further reductions in adsorbent size would probably not show much improvement since the adsorbents would eventually become fine enough to agglomerate amongst themselves. For this it can be deduced that the ash added in the preliminary experiments to reach 40% by weight was, in effect, an adsorbent, i.e. particulate material having a hydrophilic surface. It has been found by the Applicants that the pendular bond formed between two small particles is weaker than the bond formed between a small and a much larger particle. The smallest adsorbents of FIG. 2 (mean size, 1.4 mm.) would still be considered large in comparison to the ash particles. The loss of bond strength as smaller adsorbents are used is compensated for by the increase in contact area.

BRIDGING LIQUID REQUIREMENTS

The aqueous agglomerating or bridging liquid provides the bonds that hold particles together. FIG. 3 shows the effect of aqueous agglomrating or bridging liquid volume on beneficiation. When a small volume of water is added to the coal slurry in tank 4, two effects are possible. The water may be completely distributed over the ash particles, in which case the water film will be very thin or, only a fraction of the ash will be wetted, the other fraction remaining dry. The adsorbent for FIG. 3 is dry silica (− 10 + 28 mesh), and is present in excess to the extent that 200 g of silica were added per 47g of coal. When the poorly coated or partially wetted ash contacts the dry adsorbent the water spreads itself even more. The bonds formed are very weak. As the volume of water increases, the chances of all the ash particles being wetted also increase. The film of water covering the particles thickens, and the bonds formed become stronger. Eventually an optimum water content is reached. As this optimum level is passed, the water film becomes too thick, and tends to be easily displaced from the adsorbent back into the suspending liquid. Water bubbles remain in suspension, carrying ash with them and when the sample is screened the water and accompanying ash pass through the screen along with the coal.

WET AND DRY ADSORBENTS

By using pre-wetted (particulate material having a hydrophilic surface) adsorbents, the chances of a dry ash particle contacting a dry adsorbent have been found to be considerably reduced and the amount of water added to the mixer need only be sufficient to wet the ash, because the adsorbent then carries its own surface moisture. Thus, as the amount of wet adsorbent increases, and consequently, the surface area available for contact, the beneficiation should improve. The adsorbents of FIG. 2 were wet, being formed by agglomeration with water from silica flour, and the above effect was quite clear. The adsorbents of FIGS. 4, 7, and 8 were wet gravel which, through continuous reuse, had become coated with thick layers of wetted ash. FIG. 4 illustrates the effect of wet adsorbent loading on % by weight of ash remaining in the coal and shows that beneficiation does improve with increasing amounts of wet gravel as the adsorbent even though the tumbling time in all cases was one hour. Although FIG. 4 does not show it, there is an optimum amount of wet adsorbent that can be used. At 375 grams of wet gravel as the adsorbent (7 mesh) the tumbler 8 was one third full. Maximum loading would mean a full tumbler, with the coal slurry filling the voids between individual wet gravel particles. At this point, however, there would be no tumbling action. Proper tumbling action, as will be shown later, is important if the ash is to be adsorbed. Thus, as the tumbler fills a level will be reached where tumbling and beneficiation begins to deteriorate.

By increasing the loading of dry adsorbent while maintaining a constant volume of water, the effects of bridging liquid requirements can be illustrated. This was done for FIG. 5, where the results for two adsorbents, dry gravel designated ● and dry silica designated O, are plotted. The effect of increasing dry adsorbent loading is exactly opposite to that for wet adsorbents. FIG. 5 also shows the effect that different adsorbing materials have upon beneficiation. Under ideal conditions both the silica and gravel beneficiate equally well, but the silica is better under non-ideal conditions. The silica is the finer of the two materials. As the loading increases the surface area of the silica increases at a faster rate than that of the gravel. The relationship shown between the bridging liquid requirements and the size of individual adsorbing particles suggests that the gravel should be the better adsorbent. The apparent contradiction of theory with test results is due to differences in surface characteristics of the two materials. The silica had a rough, irregular surface whereas the gravel had a smooth and well rounded surface. It is possible that ash particles become trapped by irregularities on the silica's surface, but is possible that this type of bonding is not important. It is more likely that the observed difference is due to the wettability of each surface. Silica, having a surface which is hydrophilic, i.e. more easily wetted, would tend to hold ash particles better than gravel. It should be noted that once the silica and gravel build up a layer of ash they then act as wet adsorbents because the wet ash forms the outer surface. All wet adsorbents should perform equally well as long as they have the same surface moisture.

SYSTEM OPERATING VARIABLES

The test results so far have stressed the importance of providing maximum chances for contact between agglomerating particles. One method of improving these chances is by increasing the time available for them to occur. The importance of tumbling was also mentioned. The effects of time and of tumbling action were studied using the same tests.

MIXING AND TUMBLING TIME

The importance of mixing time is illustrated by FIG. 6 where the mixing time for 24 g of dry silica per 47g of coal is plotted against the % by weight ash agglomeration. Short times do not allow the pump 2 to disperse the agglomerating water completely, leaving much of the ash unwetted. The optimum mixing time for the apparatus used appeared to be 10 minutes, mixing beyond this time decreased the amount of beneficiation. The pump 2 and the coal slurry appeared to heat up quite rapidly. After 5 minutes of circulating by the pump 2, the agglomerating water began to condense on the sides of the tank 1, which is open to the atmosphere. Undoubtedly, some water was lost by evaporation. By mixing past 10 minutes the water dispersion could not be improved, but the amount of lost water increased. Indeed, mixing for too long increased the chances of overdispersion and emulsification of the water, which in turn resulted in poorer wetting of the ash particles. By increasing the mixing time from 2.5 to 10 minutes the ash beneficiation was reduced by only an additional 2% by weight.

In FIG. 7 the results obtained for various tumbling times for 200 g of wet gravel per 47g of coal are plotted against the % by weight ash agglomeration. For short tumbling times the chances of contact were greatly reduced. Optimum tumbling time appeared to be 30 minutes. Beneficiation decreased after 30 minutes because more ash could not be picked up, but some ash may be abraded from the adsorbents. An equilibrium appeared to be reached between ash being adsorbed and ash being abraded. In the preliminary experiments two tests were performed under identical conditions except for tumbling times. After 1 hour of tumbling the product had 4.7% ash, but after 20 hours the product had 5.9% ash.

TUMBLING ACTION

The tumbling action of the adsorbents can be altered by changing the speed of rotation of the tumbler. For agglomeration the best action is a gentle cascading one. In FIG. 8 the peripheral speed of the tumbler interior is plotted against the % by weight ash beneficiation using 200 g of wet gravel for 47g of coal. From the graph the best cascading appeared to occur between 30 and 70 centimeters per second. For low speeds the adsorbents did not appear to contact the ash particles with sufficient force for strong bonds to form. Also, at lower speeds the slurry did not appear to mix as much as with higher speeds and ash particles in suspension appeared to have fewer chances of contacting the adsorbents. With the highest speeds the adsorbents appeared to be held against the tumbler by centrifugal force, resulting in very little contact with ash particles. A separate test was performed using a pelletizing disc instead of the tumbler 8 and dry silica instead of wet gravel. The disc was rotated until the best cascading action was observed and the product ash was 4.8% by weight.

SYSTEM VERSATILITY

The process according to the present invention would be of little value if it worked only for bituminous coal suspended in either varsol, hexane, or trichloroethelene. The versatility of the process was tested by using different coals in hexane and bituminous in different suspending liquids. Various agglomerating liquids were used in the preliminary tests but none proved better than water.

The results obtained with different suspending liquids are listed in the following Table 2 where the process according to the present invention is shown to work well in a wide variety of liquids.

TABLE 2

| Suspending Liquid | Final % by weight Ash | % by weight Combustible Recovery |
|---|---|---|
| Hexane | 4.9 | 92.6 |
| Varsol | 4.6 | 93.0 |
| Trichloroethylene | 4.8 | 92.9 |
| BTX | 4.8 | 94.5 |
| Syncrude | 4.4 | 91.8 |
| Leduc | 3.4 | 93.1 |
| Kerosine | 4.9 | 91.1 |

The Leduc is an unrefined crude from Alberta and the Syncrude, also from Alberta, is refined, hydrogenated synthetic crude from tar sands. The BTX is a benzene, toluene, xylene mixture. The results obtained with Leduc were lower than all the previous tests, none of which reduced the ash below 4% by weight. It should be noted that the crudes produce very good results in the forward process.

Two other bituminous coals were tested and the following Table 3 lists the results, which once again indicate that the process according to the present invention is not a limited one.

TABLE 3

| | Starting | | Final % Ash | |
|---|---|---|---|---|
| Coal | % Ash | % Sulfur | Centrifugal Pump[a] | Paint Shaker[b] |
| Polish | 20 | <1 | 5.5 | 6.8 |
| Western Canadian | 20 | <1 | 6.7 | 7.4 |
| Eastern Canadian | 20 | 4 | 13.3 | 13.8 |

[a]200 grams of wet adsorbent
[b]26 grams of dry silica adsorbent

Each coal was subjected to the same conditions, which were not necessarily optimum for that particular coal. When the pump 2 was used as the mixer, wet adsorbents were used. Silica was used for mixing with the paint shaker. Compared with the bituminous and Western Canadian coals the Eastern Canadian coal showed poor results. Although all three assayed 20% by weight ash approximately 4% by weight of the ash was in the form of pyritic sulfur for the Eastern Canadian coal. The other two coals had sulfur contents less than 1%. Sulfur, whether it be pyritic or organic, has always proven difficult to remove because of its hydrophobic character. Organic sulfur is virtually impossible to remove but several methods have been devised for removing pyritic sulfur. Also, it may be possible to condition the pyritic sulfur with chemical agents, thus making it more wettable. Undoubtedly, further tests with the two Canadian coals would improve the results.

COAL RECOVERY

A further important consideration in the use of the process according to the present invention is the amount of coal that can be recovered. Some recoveries are given in the above Tables 1 and 2. For 17 tests in which the final product assayed 7% by weight ash or less, the average recovery was 94% by weight. Recoveries using the paint shaker averaged about 10% by weight lower than for the centrifugal pump, indicating that the type of mixing affects coal recovery.

ADVANTAGES OF THE REVERSE PROCESS

The main reasons for developing the reverse process according to the present invention were: (1) to avoid agglomerating the major constituents (coal) and (2) to eliminate tailings problems caused by long settling times by producing dense, relatively dry agglomerates. In developing the tar sands, for instance, very long settling times are being encountered. By agglomerating the inorganic materials these settling times can be avoided. Also, by using a binder for the inorganic material, such as sodium silicate, dispersed or dissolved in water, rather than water alone, the dried agglomerates, which may be fired, would be strong enough to use as aggregate. It is possible to agglomerate the tailings from the forward process, but this is an extra step requiring the use of costly flocculents.

Due to the large quantities of water used in the forward process the coal concentrate has a moisture content of approximately 30%. This undesirably high level, which also results in the case of flotation, is avoided with the reverse process since small quantites of water are used. Ideally, all the water is used in wetting and agglomerating the ash. Both the forward and reverse processes used sequentially produce an ideal product for coal-in-oil pipelining. The forward process used may be that described in U.S. Pat. No. 3,665,066, dated May 23, 1972, C. E. Capes, A. E. McIlhinney and R. D. Coleman. This is especially true since both processes work well with crude oils.

When the forward and reverse processes are combined, starting with an aqueous suspension of the coal, the water is preferably displaced by agglomerating the coal using a portion of the liquid hydrocarbon oil as the agglomerant, the coal agglomerates thus obtained are mixed with the remainder of the liquid hydrocarbon oil to form a suspension, and then the process according to the present invention is carried out. Preferably the coal is agglomerated by adding the liquid hydrocarbon oil in the range 0.5:1 to 1.2:1 by volume of liquid hydrocarbon oil to that of solids (coal) so that the minimum content of moisture remains in the coal agglomerates. Most of this remaining moisture is removed with the agglomerated ash in the following reverse process so that the final moisture content in the coal is so low that thermal drying is unnecessary. The following Table 4 shows the tests results of a comparison between the forward process alone and the combined forward and reverse processes.

TABLE 4

| Ash Remaining in Coal | | Moisture | | Recovery | |
|---|---|---|---|---|---|
| Forward (%) | Combined (%) | Forward (%) | Combined (%) | Forward (%) | Combined (%) |
| 4.5 | 3.3 | 22.3 | 6.2 | 96.4 | 94.7 |
| 4.7 | 3.3 | 20.8 | 5.8 | 96.1 | 94.7 |

TABLE 4-continued

| Ash Remaining in Coal | | Moisture | | Recovery | |
|---|---|---|---|---|---|
| Forward (%) | Combined (%) | Forward (%) | Combined (%) | Forward (%) | Combined (%) |
| 4.7 | 3.4 | 19.5 | 7.0 | 95.8 | 94.6 |

Tests conditions:
Forward Feed: 20% ash, 95% — 200 mesh
30cc. of light fuel oil used to treat 50 grams of feed suspended in 450 ml. of water.
Forward concentrate suspended in 300 ml. of hexane and tumbled 30 minutes with 100 grams of silica chips to produce combined concentrate.

If the coal is initially in the form of an aqueous suspension it is also possible to filter the coal and then mix the filter cake thus produced with the liquid hydrocarbon oil. Again moisture remaining with the coal after filtering will tend to be removed with the ash agglomerates. As an example a bituminous coal (60%—100 mesh) was used as a filter cake, its initial moisture was 33% by weight. Tumbling 80 grams of this cake for 15 minutes with 200 grams of silica gave a product of 8.9% by weight moisture and 7.7% by weight ash.

We claim:

1. A method of separating inorganic materials from coal, comprising:

a. providing the coal, containing the inorganic materials, in particulate form as a suspension with a liquid hydrocarbon oil, b. mixing an aqueous agglomerating liquid comprising water, which is immiscible with the liquid hydrocarbon oil, with the suspension, c. mixing a particulate material having a hydrophilic surface that is readily wetted by liquid water with the suspension, d. agitating the suspension, with the aqueous agglomerating liquid and particulate material having a hydrophilic surface mixed therewith, to agglomerate inorganic particulate materials in the suspension with the aid of the said particulate material having a hydrophilic surface, while leaving at least a major portion of the particulate coal dispersed in the liquid hydrocarbon oil, and then e. separating the agglomerated inorganic material from at least a major portion of the liquid hydrocarbon oil and pulverized coal.

2. A method according to claim 1, wherein the particulate material having a hydrophilic surface is wetted with aqueous agglomerating liquid before being mixed with the suspension.

3. A method according to claim 1, wherein the particulate material having a hydrophilic surface is a material selected from the group consisting of ash, agglomerated silica flour, coarse silica chips, limestone and peat moss.

4. A method according to claim 1, wherein a binder for the inorganic material is dispersed or dissolved in the aqueous agglomerating liquid.

* * * * *